US009616634B2

(12) United States Patent
Liao

(10) Patent No.: US 9,616,634 B2
(45) Date of Patent: Apr. 11, 2017

(54) CUSHIONING AIR BAG WITH PREDETERMINED OPENING IN AIR CYLINDER TURNING ZONE AND MANUFACTURING THEREOF

(75) Inventor: Chieh-Hua Liao, New Taipei (TW)

(73) Assignees: AIR-BAG PACKING CO., LTD., New Taipei (TW); Chieh-Hua Liao, New Taipei (TW)

( * ) Notice: Subject to any disclaimer, the term of this patent is extended or adjusted under 35 U.S.C. 154(b) by 740 days.

(21) Appl. No.: 13/542,877

(22) Filed: Jul. 6, 2012

(65) Prior Publication Data

US 2013/0171384 A1 Jul. 4, 2013

(30) Foreign Application Priority Data

Dec. 31, 2011 (TW) ..... 100150083 A

(51) Int. Cl.

| | |
|---|---|
| ***B65D 30/10*** | (2006.01) |
| ***B65D 81/02*** | (2006.01) |
| ***B65D 81/03*** | (2006.01) |
| ***B31D 5/00*** | (2017.01) |
| *B65D 30/24* | (2006.01) |

(52) U.S. Cl.

CPC ..... *B31D 5/0073* (2013.01); *B65D 81/02* (2013.01); *B65D 81/03* (2013.01); *B31D 2205/0047* (2013.01); *B31D 2205/0064* (2013.01); *B65D 31/14* (2013.01); *Y10T 428/1334* (2015.01)

(58) Field of Classification Search

CPC ..... B65D 81/052; B65D 81/02; B65D 81/03; B65D 81/05; B65D 81/051; B65D 31/14; B65D 31/142; B65D 31/145; B65D 31/147

USPC ..... 383/2, 3, 43, 44; 206/522

See application file for complete search history.

(56) References Cited

U.S. PATENT DOCUMENTS

| | | | | |
|---|---|---|---|---|
| 2005/0263425 | A1* | 12/2005 | Tanaka et al. | 206/522 |
| 2007/0295633 | A1* | 12/2007 | Liao et al. | 206/522 |
| 2008/0159659 | A1* | 7/2008 | Liao et al. | 383/3 |
| 2009/0050509 | A1* | 2/2009 | Liao et al. | 206/522 |
| 2009/0127153 | A1* | 5/2009 | Kim | 206/522 |

* cited by examiner

*Primary Examiner* — Jes F Pascua
*Assistant Examiner* — Nina Attel
(74) *Attorney, Agent, or Firm* — Rabin & Berdo, P.C.

(57) ABSTRACT

A method for making a cushioning air bag with a predetermined opening in an air cylinder turning zone, including: providing an air cylinder sheet; adhering the two sheets of outer film to form turning points; determining a turning middle line on the air cylinder sheet; configuring nodes on two respective sides of the turning middle line; turning the air cylinder sheet along the turning middle line; and adhering two sides of the turned air cylinder sheet with lateral heat sealing lines; wherein two lateral sides of the air cylinder sheet between nodes and the turning middle line form a non-heat sealing section; a bottom surface is formed between turning points, the non-heat sealing section of the turning zone is expanded to form a lateral polygonal opening, and a supporting surface is formed on a bottom of the opening, after the air cylinder sheet is filled with air.

10 Claims, 15 Drawing Sheets

CUSHIONING AIR BAG WITH PREDETERMINED OPENING IN AIR CYLINDER TURNING ZONE AND MANUFACTURING THEREOF

CROSS-REFERENCES TO RELATED APPLICATIONS

This non-provisional application claims priority under 35 U.S.C. §119(a) on Patent Application No(s). 100150083 filed in Taiwan, R.O.C. on 2011 Dec. 31, the entire contents of which are hereby incorporated by reference.

TECHNICAL FIELD

The present invention relates to an air cylinder bag structure, and more Specifically to a cushioning air bag with a predetermined opening in an air cylinder turning zone and a method for making it.

BACKGROUND

Currently, bubble paper or PVC is mostly used to cover an article upon packing of the article, but the cushioning effect is not good, and environmental pollution is a byproduct. To solve the defects of bubble paper and PVC, an air packing bag is developed, which is heat-sealed to form airtight air cylinders, and configured with air filling entrances allowing air filling; the air packing bag can be used as a cushioning material in interior packaging after air is filled in the air cylinders through the air filling entrances.

However, bending areas at the bottom of a general package bag usually cannot present a flat shape; an outward protuberance is always naturally generated due to compression of air pressure after the package bag is filled with air and expanded, such that the package bag cannot be placed on a level surface stably.

SUMMARY

To improve an air packing bag, the present invention proposes a cushioning air bag with a predetermined opening in an air cylinder turning zone, including: an air cylinder sheet, constituted by a plurality of air cylinders formed by adhering two sheets of outer film with a plurality of longitudinal heat sealing lines and a plurality of transversal heat sealing lines; a plurality of turning points, formed on the plurality of air cylinders or the plurality of longitudinal heat sealing lines by adhering the two sheets of outer film; a turning middle line, position on the air cylinder sheet, parallel substantially to the plurality of transversal heat sealing lines; a plurality of nodes, positioned on two respective sides of the turning middle line, and at a predetermined distance from the turning middle line; and a plurality of lateral heat sealing lines, used to stick two sides of the turned air cylinder sheet after the air cylinder is turned along the turning middle line, wherein, the plurality of lateral heat sealing lines are extended from two respective ends of the air cylinder sheets to the corresponding plurality of nodes, two lateral sides of the air cylinder sheet between the plurality of nodes and the turning middle line form a non-heat sealing section in a turning zone; wherein a bottom surface is formed between the plurality of turning points, the non-heat sealing section is expanded to form a lateral polygonal opening, and a supporting surface is formed on a bottom of the opening, after the air cylinder sheet is filled with air.

The present invention also proposes a method for making a cushioning air bag with a predetermined opening in an air cylinder turning zone, including: providing an air cylinder sheet, constituted by a plurality of air cylinders formed by adhering two sheets of outer film with a plurality of longitudinal heat sealing lines and a plurality of transversal heat sealing lines; adhering the two sheets of outer film to form a plurality of turning points on the plurality of air cylinders or the plurality of longitudinal heat sealing lines; determining a turning middle line on the air cylinder sheet, parallel substantially to the plurality of transversal heat sealing lines; configuring a plurality of nodes on two respective sides of the turning middle line at a predetermined distance from the turning middle line; turning the air cylinder sheet along the turning middle line; and adhering two sides of the turned air cylinder sheet with a plurality of lateral heat sealing lines; wherein, the plurality of lateral heat sealing lines are extended from two respective ends of the air cylinder sheets to the corresponding plurality of nodes, two lateral sides of the air cylinder sheet between the plurality of nodes and the turning middle line form a non-heat sealing section; a bottom surface is formed between the plurality of turning points, the non-heat sealing section of the turning zone is expanded to form a lateral polygonal opening, and a supporting surface is formed on a bottom of the opening, after the air cylinder sheet is filled with air.

The present invention eliminates pointed corners by presetting non-sealing sections in a lateral turning zone, and further utilizes a turning node zone being positioned at an air cylinder and a bottom air cylinder between the turning nodes, allowing an area change of the air cylinder to adjust a cushioning effect of the region. In addition, a volume of an outer box can be reduced, and air leaking of the air cylinder due to a crevice caused from pointed corner friction can be eliminated. Adjustment of an air cylinder around a triangle of the opening is used to fit a wrapped object, avoid pointed corners, and increase a cushioning effect. Furthermore, the bottom cushioning air cylinder structure eliminates perplexity of lateral side sealing of a bag body causing pointed corners due to air compression after the bottom air cylinder is filled with air, in the prior art. Additionally, the areas of the nodes of the lateral turning zone and the air cylinder at that portion can be increased and reduced by means of heat sealing, thereby strengthening a cushioning effect of the turning zone.

BRIEF DESCRIPTION OF THE DRAWINGS

The present invention can be more fully understood by reference to the following description and accompanying drawings, wherein.

DETAILED DESCRIPTION

Figure 1:
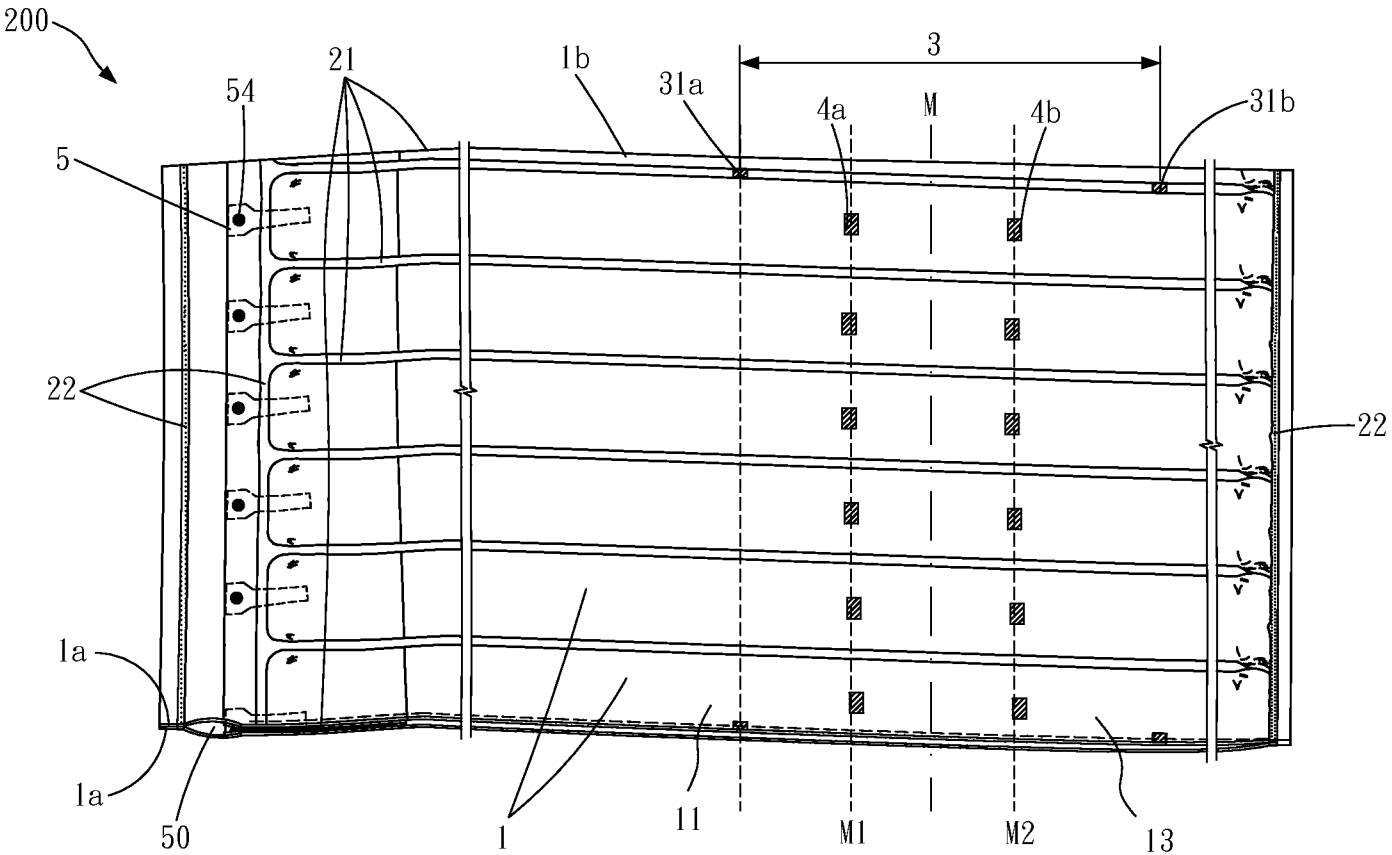
FIG. 1 is a schematic view of an outlook of a first embodiment according to the present invention while being not filled with air.
Figure 2:
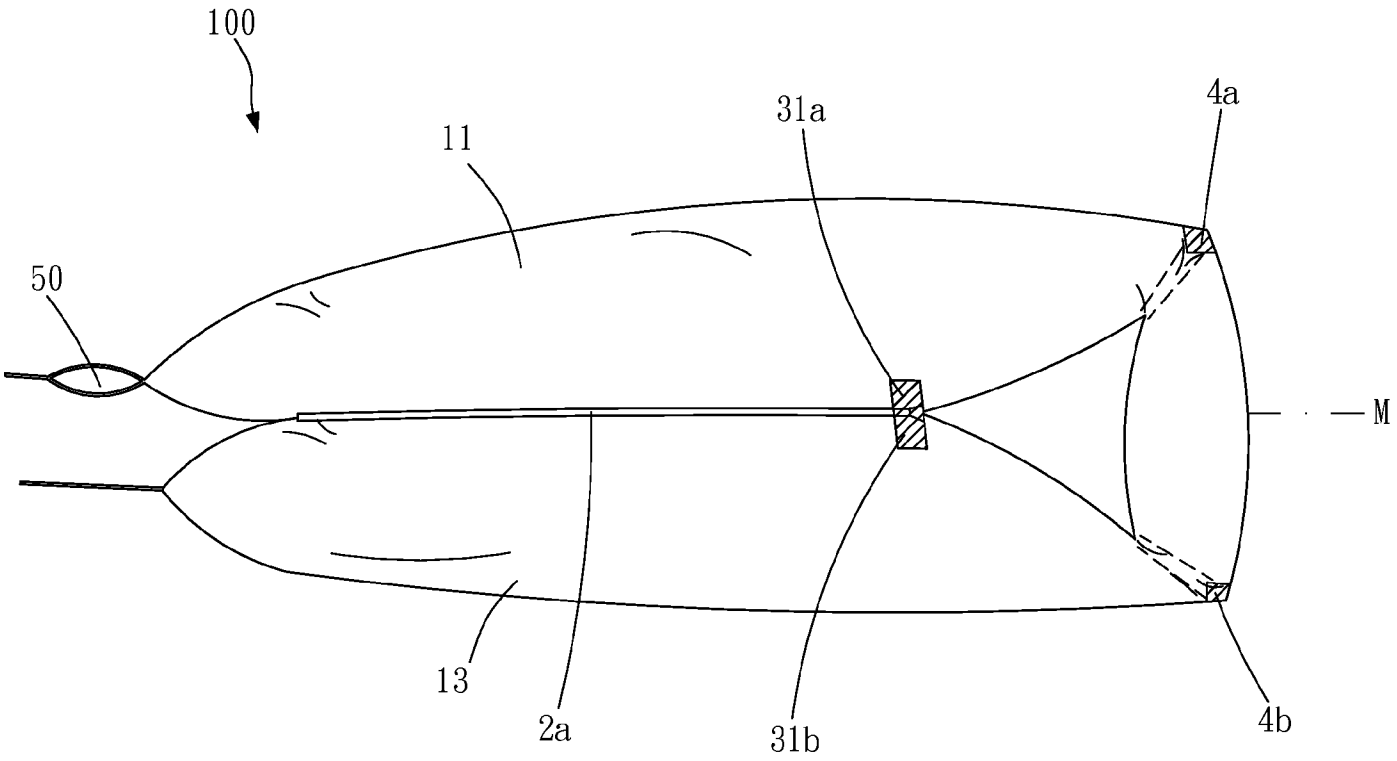
FIG. 2 is a cross-sectional view of the first embodiment of the present invention while being filled with air.

Please refer to FIGS. 1 and 2, which illustrate a cushioning air bag in which an air cylinder turning zone is preset with an opening disclosed by the present invention.

An air cylinder bag of the present invention includes a cylinder sheet 200, a plurality of longitudinal heat sealing lines 21, a plurality of transversal heat sealing lines 22, a plurality of turning points 4*a*, 4*b*, and a respective non-heat sealing section in a predetermined turning zone at the two sides of the bag and a predetermined reduced area required for air cylinders in the non-heat sealing section of a turning zone.

The air cylinder sheet 200 is formed of two sheets of outer film 2 by means of heat sealing, and a plurality of hermetically sealed bodies formed of the air cylinder sheet 200 containing check valves capable of locking air after air filling by means of heat sealing are referred to air cylinders, where an air filling passageway 50 in air communication with the air cylinders 1 and air inlet 52 of each air cylinder 1 are configured in the bag. Air enters the air cylinder 1 via each air inlet 52 along the air filling passageway 50 after air filling. The air cylinders are sealed automatically after air filling because of the installment of the check valves, and the turning points 4*a*,4*b* are also disposed on the air cylinder sheet 200, allowing the air cylinders 1 to be bent to turn the air cylinder sheet 200. Thereafter, two sides of the air cylinder sheet 200 are heat sealed, allowing the air cylinder sheet 200 to become an air filling type cushioning air bag with an object storing opening 11 at one end thereof for accepting an object. The air bag is expanded to form a U-typed bent air cylinder bag after filled with air; the bag may be arranged in pairs with continuous check valves respectively used independently for each air cylinder 1 or a single sheet of check valve in air communication with each air cylinder 1. Two sheets of outer film 2 respectively have a corresponding inner face, and an accepting space 10 is formed among a plurality of face-to-face inner surfaces, and an object storing opening 11 is so formed at one end of the air cylinders. The outer film 2 above are made from a hot melt hot-sealable material such as polyester, polyethylene-polypropylene copolymer, PET, EVA, nylon, a film compounded with PE, biodegradable materials, paper coated with polymer, or the same, but the present invention is not so limited.

As shown in FIG.1, the turning points 4*a* forms a first turning line M1, and the turning points 4*b* forms a second turning line M2. The first turning line M1 and the second turning line M2 are parallel to at least one axis of plurality of the transversal heat sealing lines 22. A turning middle line M is defined at the middle between the first turning line M1 and the second turning line M2. The air cylinder sheet 200 is folded in half to form a U-typed air bag along turning line M1 and second turning line M2, as FIG. 1 shows, two sides of the air bag are combined with each other through lateral heat sealing lines 2*a* to form a bag body 100 for use. The two sides 1*b* herein are preferably adhere together by means of heat sealing, however in practical use, they can be adhered together through an adhesive or other means, but the present invention is not so limited. Specifically, the turning points 4*a*, 4*b*, the turning middle line M and the non-heat sealing section 3 of the turning zone (i.e. from nodes 31*a* to nodes 31*b*), are disposed on the air cylinders, the air cylinder sheet 200 is folded in half along the turning line M, and the sides positioned on the turning zone 3 are not heat sealed when the two sides 1*b* are adhered together by means of heat sealing through the heat sealing lines 2*a*. Specifically, the two sides outside the non-heat sealing section 3 of the turning zone are adhered together by means of heat sealing and the sides inside the non-heat sealing section 3 of the turning zone are open. The turning middle line M is a virtual line; it being a middle line for folding the air cylinder sheet 200 in half is sufficient, instead of adhering the two sheets of outer film 1*a* together by means of heat sealing.

The node 31*a* herein, as FIG. 1 shows, may be a starting point, and the node 31*b* may be an end point; this section is an open area predetermined which is not heat-sealed, i.e. it constitutes the non-heat sealing section 3 of the turning zone. The node 31*a* , 31*b* are positioned on two outermost ones of the longitudinal heat sealing lines 21 of the air cylinder sheet 200.

Figure 3:
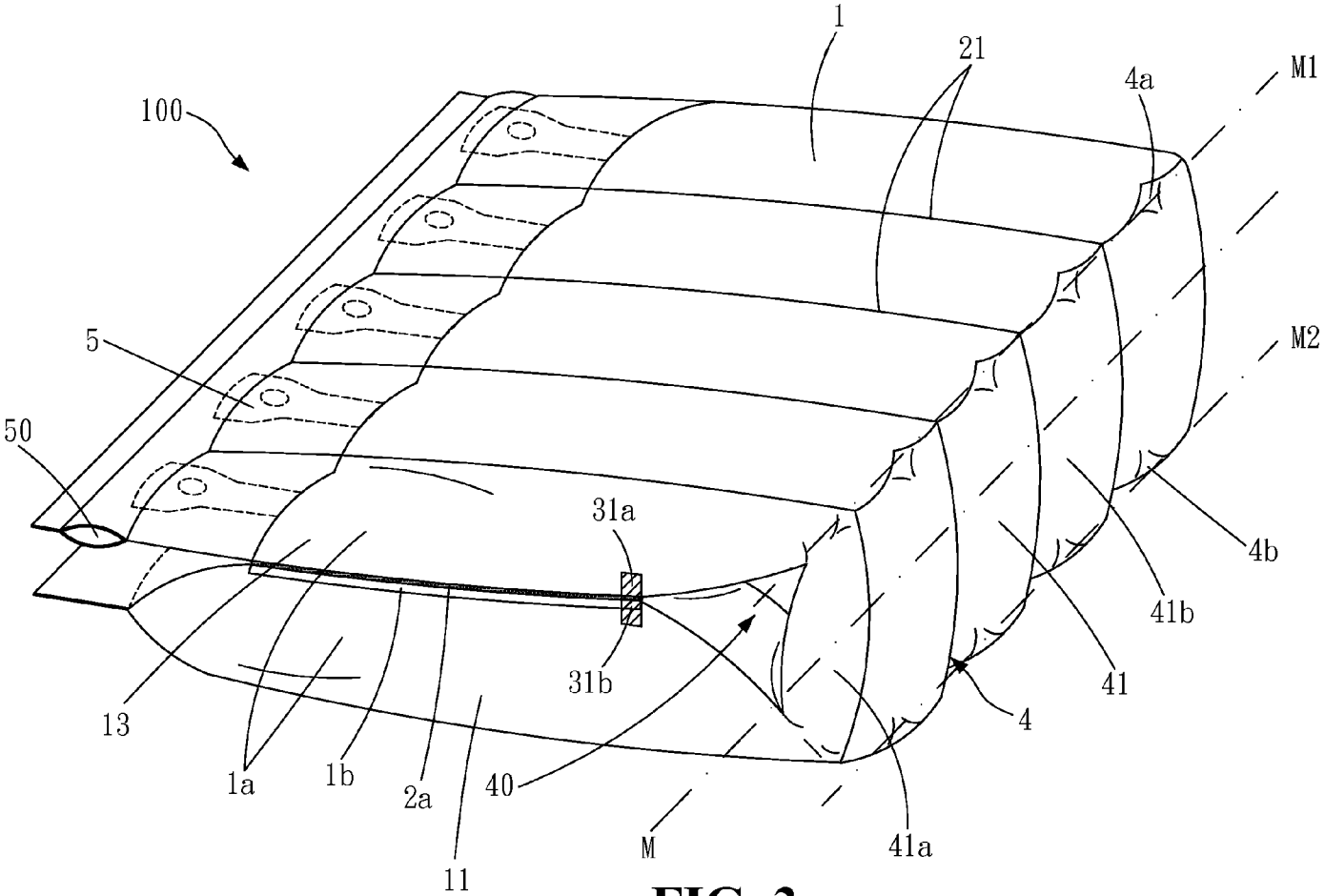
FIG. 3 is a schematic view of an outlook of the first embodiment according to the present invention while being filled with air.
Figure 4:
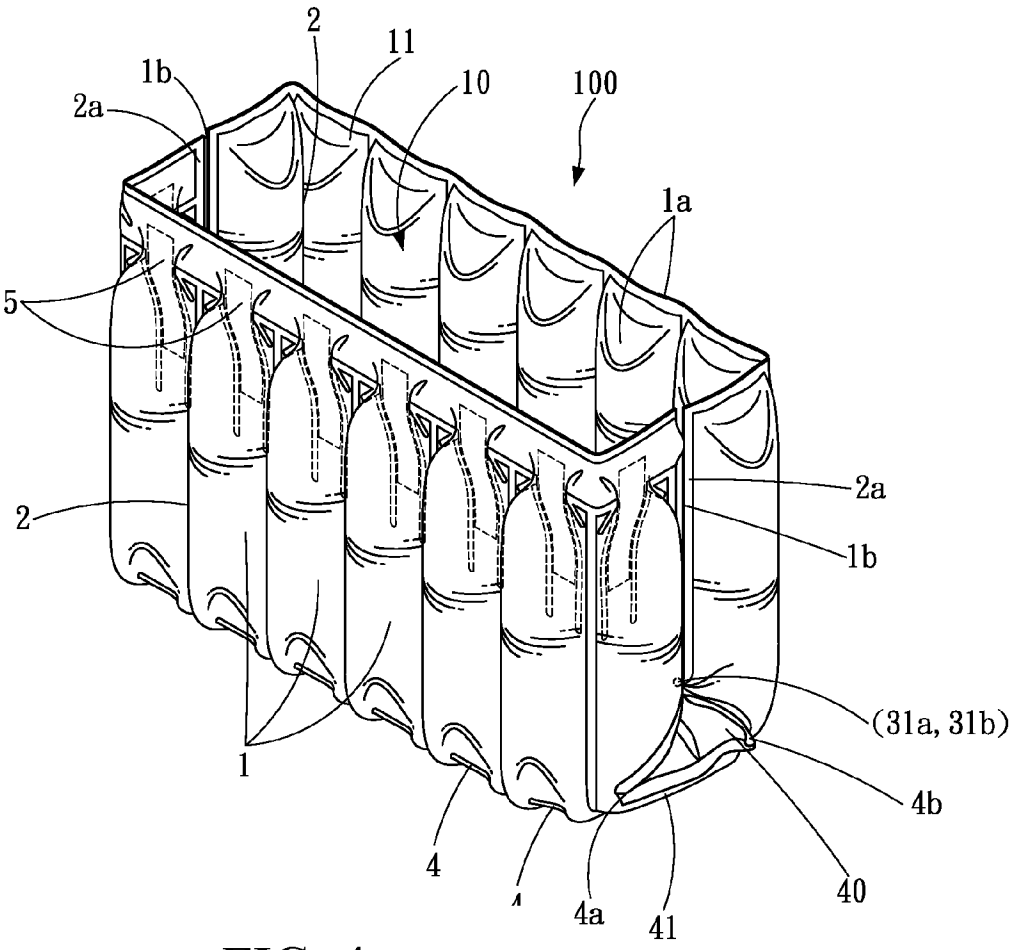
FIG. 4 is another schematic view of an outlook of the first embodiment according to the present invention while being filled with air.

Please refer to FIGS. 2, 3 and 4, in which since the section of the lateral heat sealing line 2*a* from the node 31*a* to the node 31*b* is not heat sealed, the lateral air cylinder 1 at the reserved non-heat sealing section 3 of the turning zone is expanded automatically to form a triangular cylinder opening 40 after the air cylinder sheet 200 is filled with air. This structure is simple, without the pointed protrusions at a corner air cylinder that usually happen in a conventional air bag, preventing the air cylinder sheet 200 from leaking due to a fissure caused from the abrasion of the pointed protrusion with an outer box upon transportation Additionally, the air cylinder 1 at the zone stay flatly close to a side of the outer box, thereby achieving a volume reduction, a cushioning effect of the section can be increased due to the triangular lateral air cylinder. The nodes 31*a*, 31*b* are marks being not necessarily heat sealing nodes. In addition, as shown in FIG. 3. the nodes 31*a*, 31*b* positioned on two respective sides of the turning middle line M contac to each other after the air cylinder sheet 200 is filled with air. The two portions 11, 13 of each air cylinders 1 positioned on two respective sides on non-heat sealing section 3 also to each other.

Figure 5:
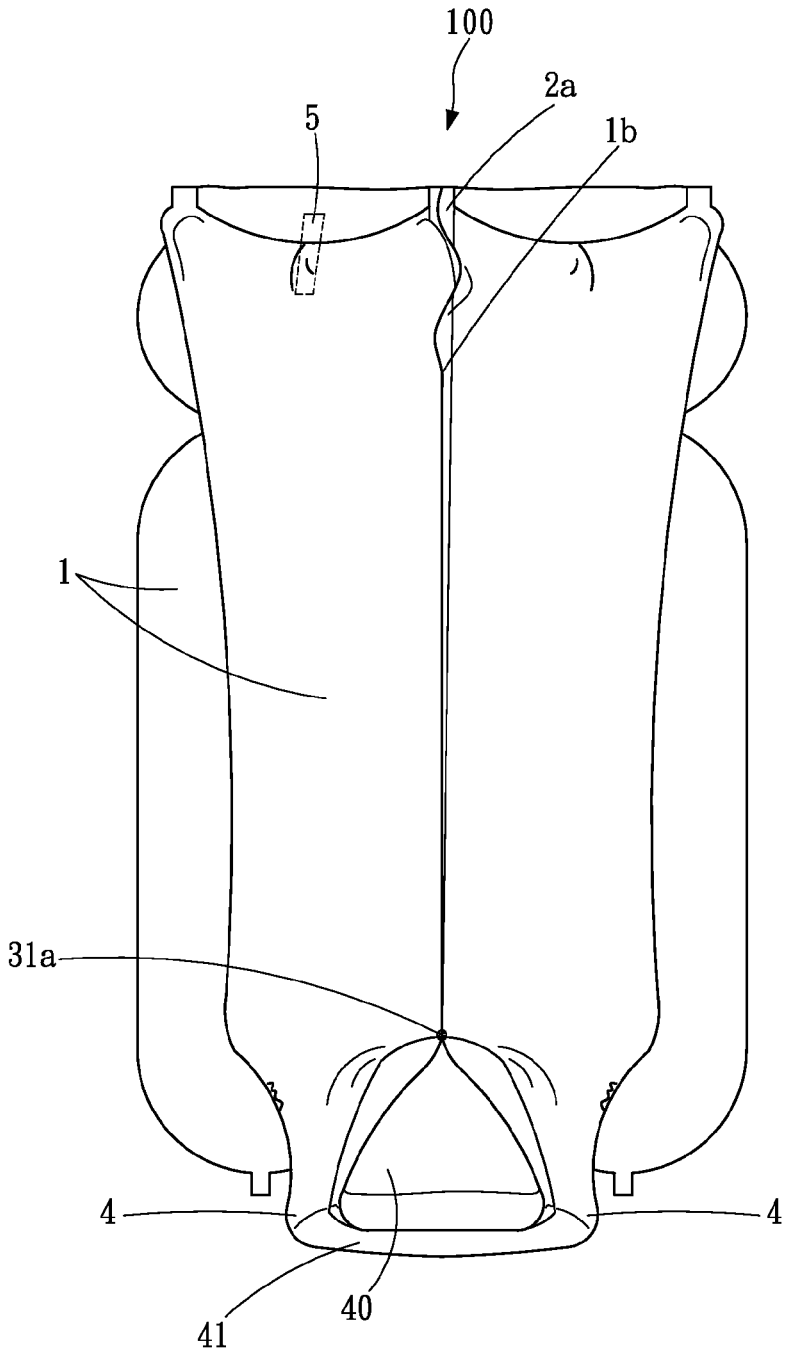
FIG. 5 is a lateral view of the first embodiment of the present invention while being filled with air.

Please refer to FIGS. 3 and 5, in which two compressed corners 4 are positioned on the plurality of outer film 1*a*; the compressed corners 4 will be respectively formed on bent positions when the plurality of outer film 1*a* are filled with air to form air cylinders 1, and bent into a U-typed body. Consequently, the distance between the two sheets of outer film 1*a* at the bent position is smaller than the distance between the sheets of outer film 1*a* at other positions where the air cylinder 1 is not bent; the not-heat sealing section 3 of the turning zone combines substantially with the positions of the compressed corners 4 at the two sides to form a triangular body, and a bottom cushioning air cylinder 41 with a supporting surface 41*a* is included between the compressed corners 4 at the two sides. More specifically, a bottom surface 41*b* is formed between the nodes 31*a*, 31*b* of the air cylinder sheet 200 after the air cylinder sheet 200 is filled with air, and the non-heat sealing section 3 of the turning zone is expanded to form the lateral polygonal opening 40 and so the supporting surface 41*a* on the bottom of the opening 40. An object in the accepting space 10 will be against the bottom cushioning air cylinder 41 and the supporting surface 41*a* of the bottom cushioning air cylinder 41 may be against the table surface to perform a cushioning function after the object is placed in the bag body via the object storing opening 11. In addition, the plurality of outer films 1*a* is expanded by filling with air, and an opening 40 is so formed at the triangular zone.

Figure 6:
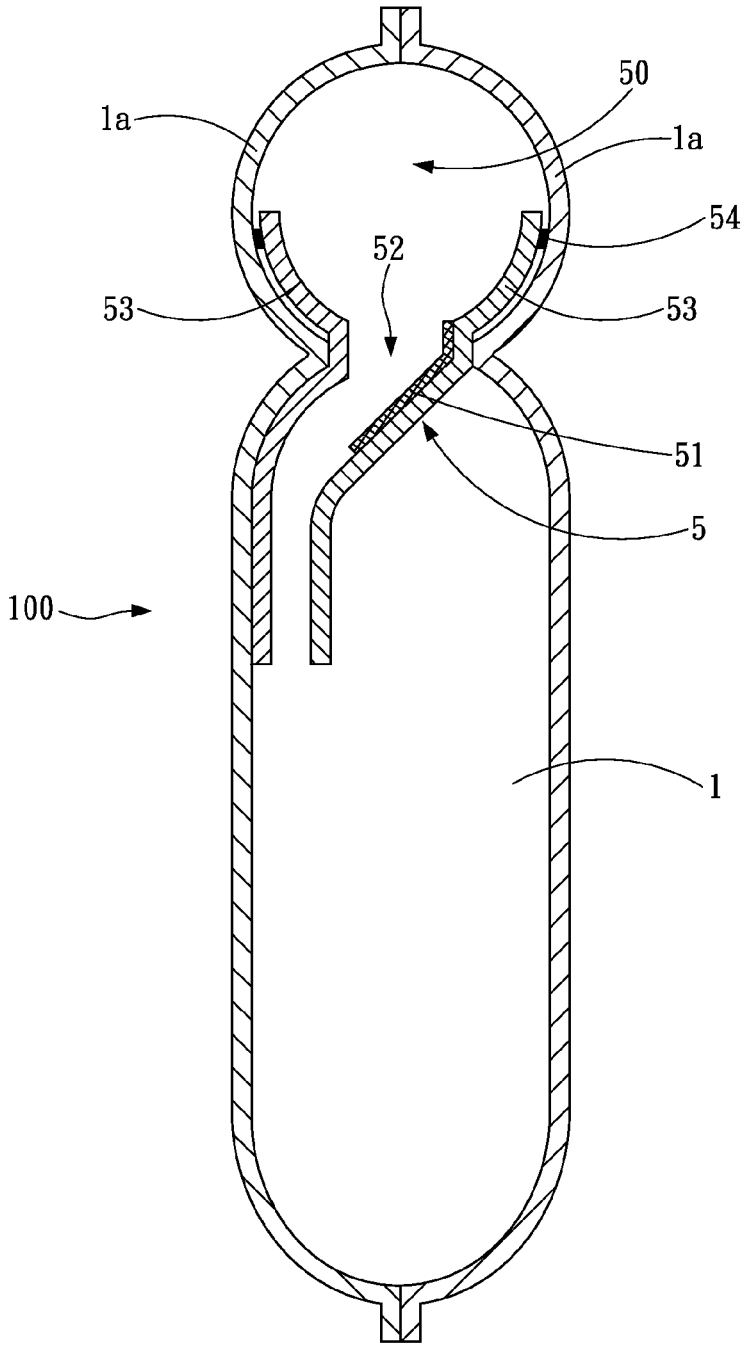
FIG. 6 is a lateral cross-sectional view of the first embodiment of the present invention while being filled with air.
Figure 7:
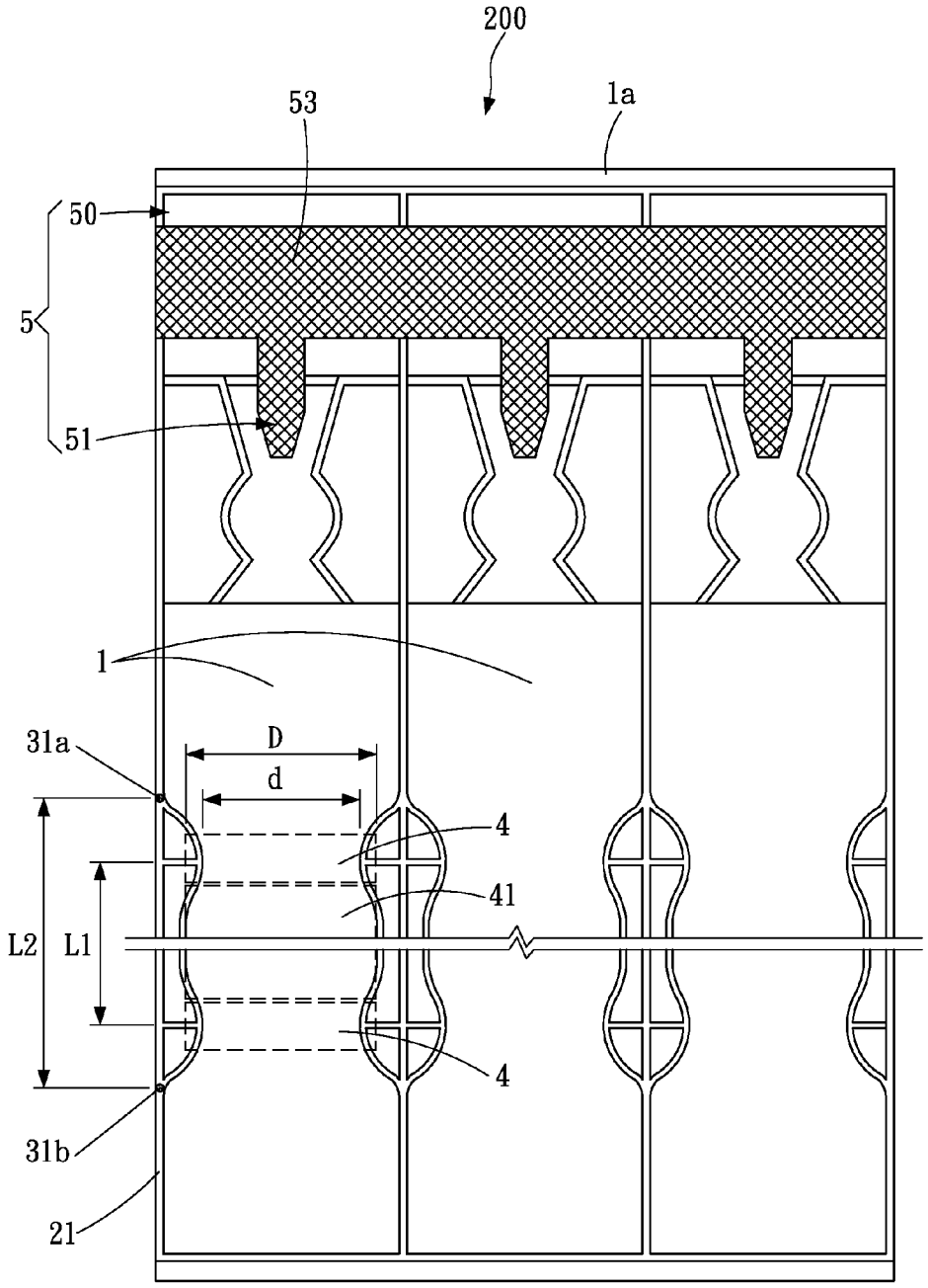
FIG. 7 is a top view of a second embodiment of the present invention while being not filled with air.

Please refer to FIGS. 6 and 7, in which in the present embodiment, the air cylinder sheet 200 may be configured with a check valve, a plurality of air inlets 52 may be formed between two sheets of inner film 53, and each air inlet 52 corresponds to one air cylinder 1. The structure of the check valve 5 herein is only an example; a structure with a similar effect can only be configured depending on a practical structure requirement, and the present invention is not so limited. For example, each air cylinder may be configured with its own check valve 5 such that only one air inlet 52 is formed between the two sheets of inner film 53 of the check valve 5. One part of the check valve 5 is positioned between the two sheets of outer film 1*a* and another part of the check valve 5 is exposed out in the air filling passageway 50. In the present embodiment, the air filling passageway 50 is preferably formed by adhering the two sheets of outer film 1*a* together by means of heat sealing, providing a route for air filling.

Specifically, the check valve 5 has a heat-resistant material 51, which is stuck to form the air inlet 52 by means of heat sealing, where the air inlet 52 is in air communication with the air filling passageway 50. Preferably, the check valves 5 are formed by adhering the plurality of inner film 53 together by means of heat sealing, and a plurality of heat sealing switches 54 are included between the plurality of inner films 53 and the plurality of outer films 1*a*. The two sheets of outer film 1*a* are pulled apart outward after air is filled into the air filling passageway 50, driving each heat sealing switch 54 to pull the respective inner film 53 corresponding thereto apart outward, and further open the corresponding check valve 5, thereby allowing the air in the air filling passageway 50 to be filled between the plurality of outer films 1*a* via the check valves 5, and the space between the two sheets of outer sheet 1*a* to be expanded to form the air cylinders 1, Finally, the air cylinders 1 are bent to form a U-typed body.

The two sheets of outer film 1*a* are pulled apart outward by air pressure in the air filling passageway 50 to drive the each heat sealing switch 54 to pull the respective inner film 53 corresponding thereto apart outward, and further to open each corresponding check valve 5, allowing the air in the air filling passageway 50 to be filled between the plurality of outer films 1*a* via the check valves 5, and the space between the two sheets of outer film 1*a* to be expanded to form the air cylinders 1, and the air cylinders 1 are finally bent to form a U-typed body.

Please refer to FIG. 7, in which the figure illustrates a second embodiment of the present invention. The difference between the present invention and the first embodiment is that each two air cylinders 1 are partitioned by a heat sealing line 2, causing each two air cylinders 1 not to be in air communication with each other. An interval is included between a heat sealing line 2 and another heat sealing line 2. The position of the compressed corner 4 at this interval forms a first distance d, and the position of the bottom cushioning air cylinder 41 at this interval also forms a second distance D, where the first distance d is smaller than the second distance D. As the first distance d of the compressed corner 4 is smaller than the second distance D of the bottom cushioning air cylinder 41, the compressed corner 4 can be bent more conveniently after the air cylinders 1 is filled with air. Note in particular, a first interval L1 is included between the two compressed corners 4 on a heat sealing line 2, the non-heat sealing section 3 of the turning zone on a heat sealing line 2 is positioned between the first node 31*a* and the second node 31*b* and includes a second interval L2, where the first interval L1 is shorter than the second interval L2.

Please refer to FIGS. 8A, 8B, 9A, 9B, 10A, 10B, 11A and 11B, in which the figures illustrate embodiments of contraction of lateral air cylinders in a turning zone; the lateral air cylinders 1 in the turning zone can be contracted depending on a practical use When a lateral air cylinder 1 is large, turning it will form a natural stacking, causing the lateral air cylinder 1 to be overlarge. To avoid increasing an outer box volume, the non-heat sealing section 3 of the turning zone that the side of the lateral air cylinder 1 is not intended to be sealed is adopted to contract the volume of the air cylinder 1, thereby preventing the air cylinder 1 from being stacked and so volume-expanded after being turned. Namely, the non-heat sealing section 3 of the turning zone is referred to a section of the lateral side of the air cylinder sheet 200 that is not heat-sealed after the air cylinder sheet 200 is bent in half along the turning line M1 and the second turning line M2, i.e. the lateral side of the air cylinder sheet 200 from the node 31*a* to the node 31*b* is not heat-sealed after the air cylinder sheet is bent in half. But, the two sheets of outer film 1*a* at the non-heat sealing section 3 of the turning zone can be adhered together by means of heat sealing to form various shapes of heat sealing blocks 32 such as rectangle, half ellipse, triangle or other irregularly shaped body. However, the heat sealing block 32 is narrower than the air cylinder, and two sections of the air cylinder 1 at the two sides of the heat sealing block 32 can then be in air communication with each other and so expanded after air filling. Additionally, the heat sealing block 32 may abut upon the turning points 4*a*, 4*b*, and may also keep a distance from them, thereby allowing air flow. In addition, the heat sealing block 32 is narrower than the air cylinder and shorter than the non-heat sealing section 3 of the turning zone so as to reduce the area of the air cylinder 1 at the non-heat sealing section 3 of the turning zone.

Figure 8A:
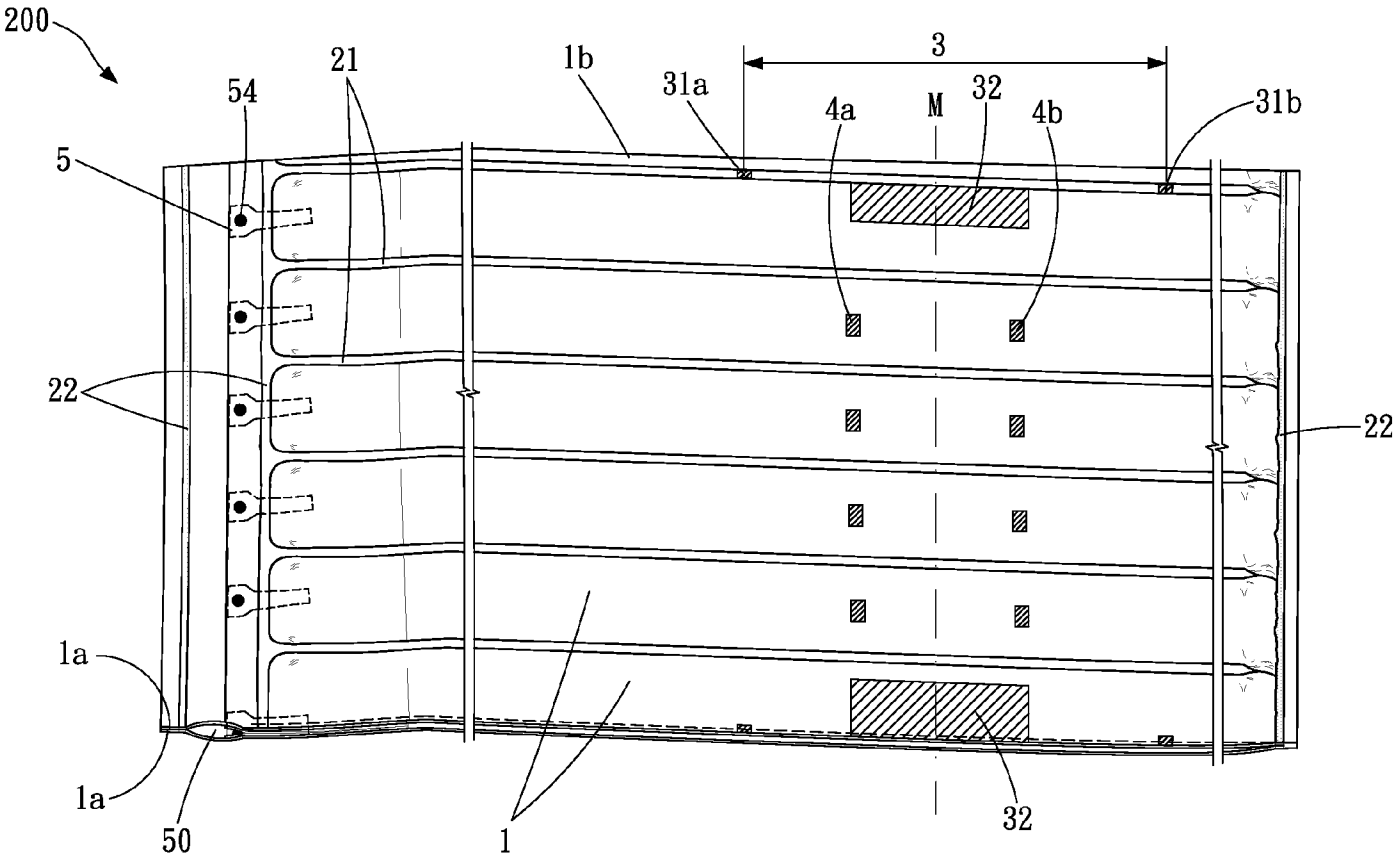
FIG. 8A is a schematic view of an outlook of air cylinder contraction in a lateral turning zoon according to the present invention.
Figure 8B:
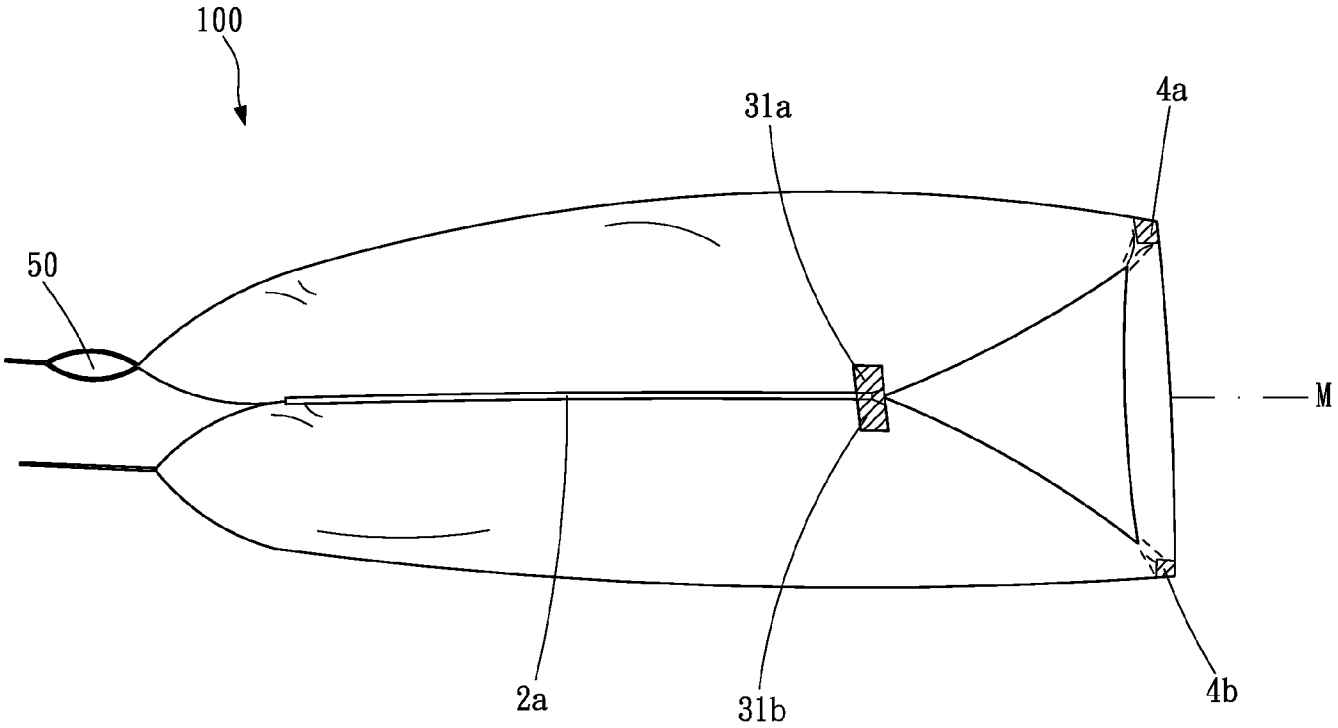
FIG. 8B is a cross-sectional view of FIG. 8A while being filled with air.

Methods for reducing the area of the lateral air cylinder 1 are the followings:

(1) Please refer to FIGS. 8A and 8B, in which contracting an inflatable area of the air cylinder 1 by adhering the air cylinder 1 from the turning point 4*a* to the other turning point 4*b* below it by means of heat sealing so that the volume of the air cylinder 1 can be reduced automatically attaining the effect of the turning zone of the air cylinder 1 becoming smaller and narrower after being turned.

Figure 9A:
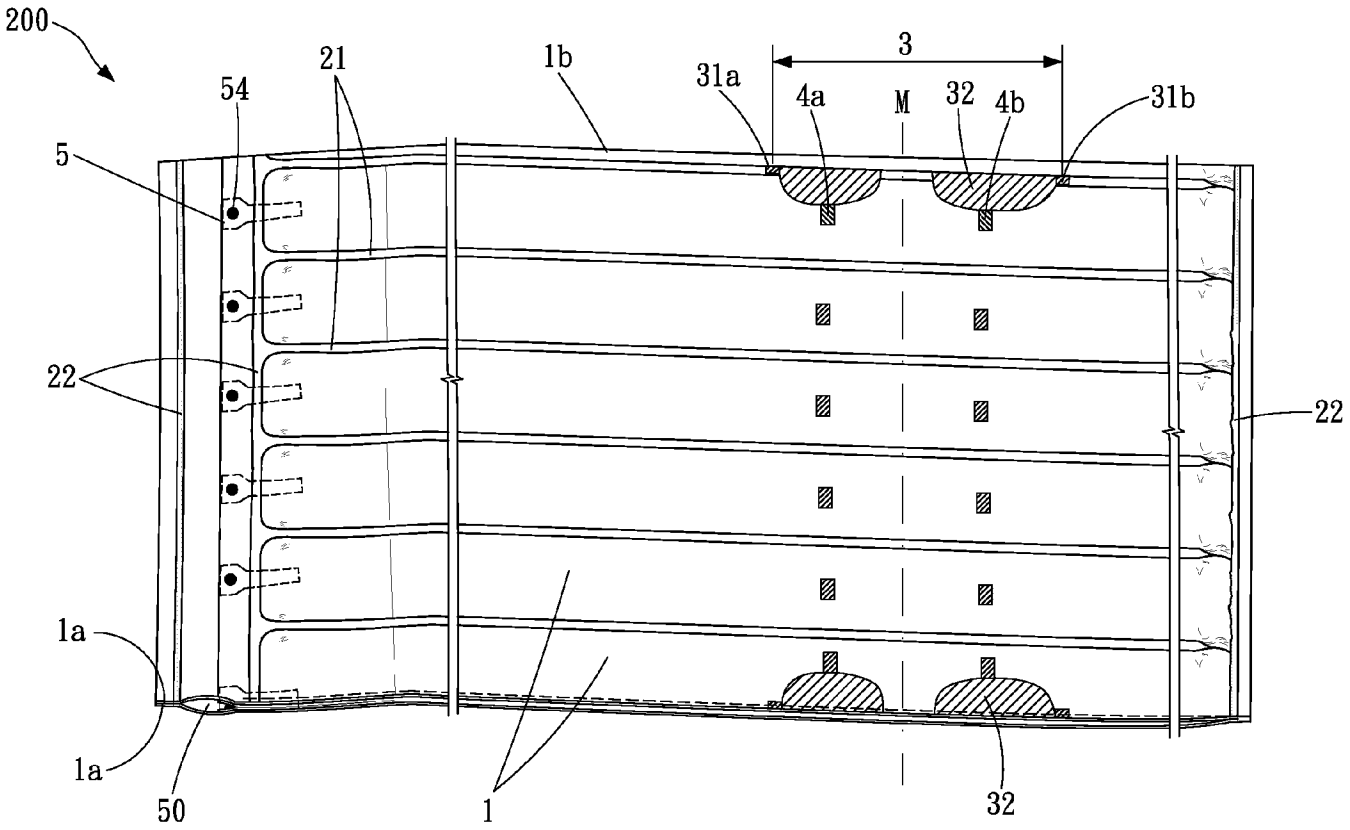
FIG. 9A is another schematic view of an outlook of air cylinder contraction in a lateral turning zone according to the present invention.
Figure 9B:
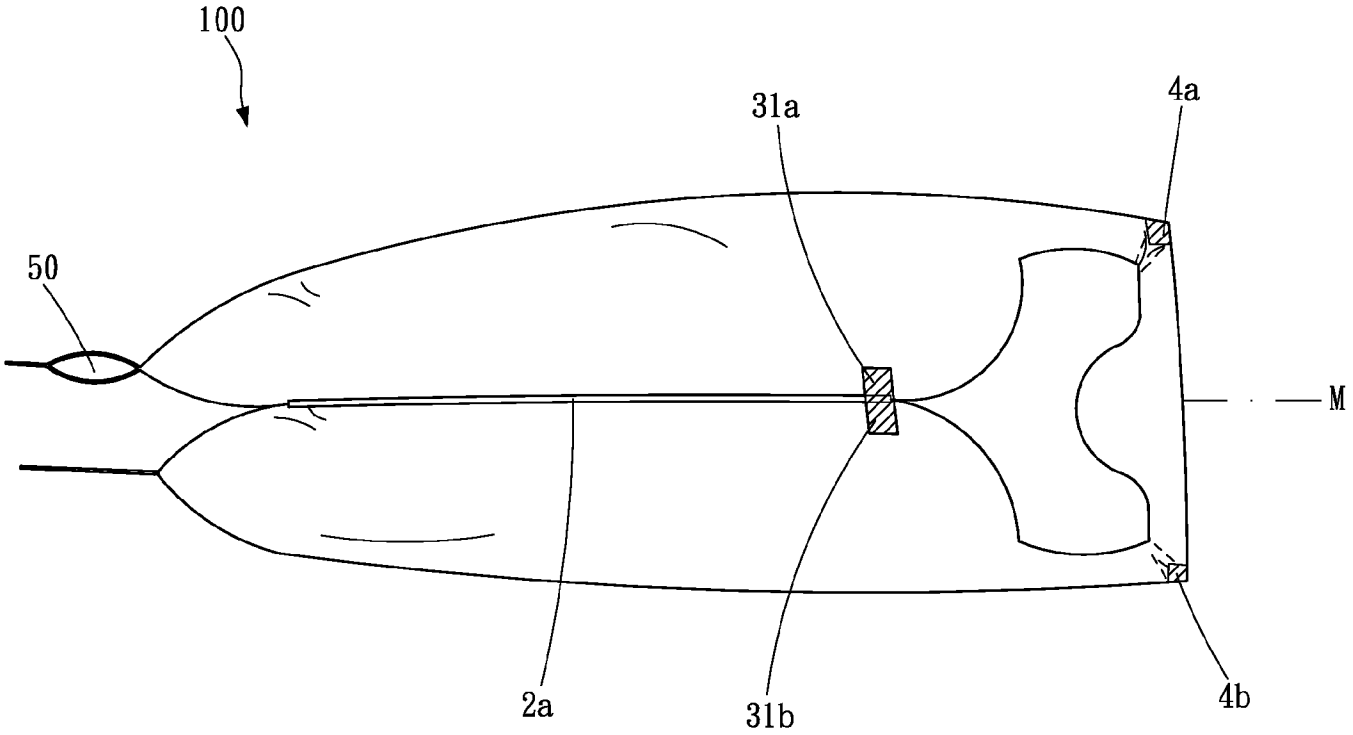
FIG. 9B is a cross-sectional view of FIG. 9A while being filled with air.

(2) Please refer to FIGS. 9A and 9B, in which forming discontinuous contractions of the turning points 4*a*, 4*b* by respectively contracting portions around the turning point 4*a* and around the turning point 4*b* so that the air cylinder 1 being wider at the opening point and becoming narrower at the turning points 4*a*, 4*b* only appears respectively at the predetermined portions around the turning points 4*a*, 4*b*, thus, not only the advantage of the cushioning air bag with the opening 40 is maintained, but the defect of the area increase of the turned air cylinder 1 due to stacking does not exist. Consequently, the configuration of the opening zone with the opening 40 does not cause the cushioning effect to be lost or reduced.

Figure 10A:
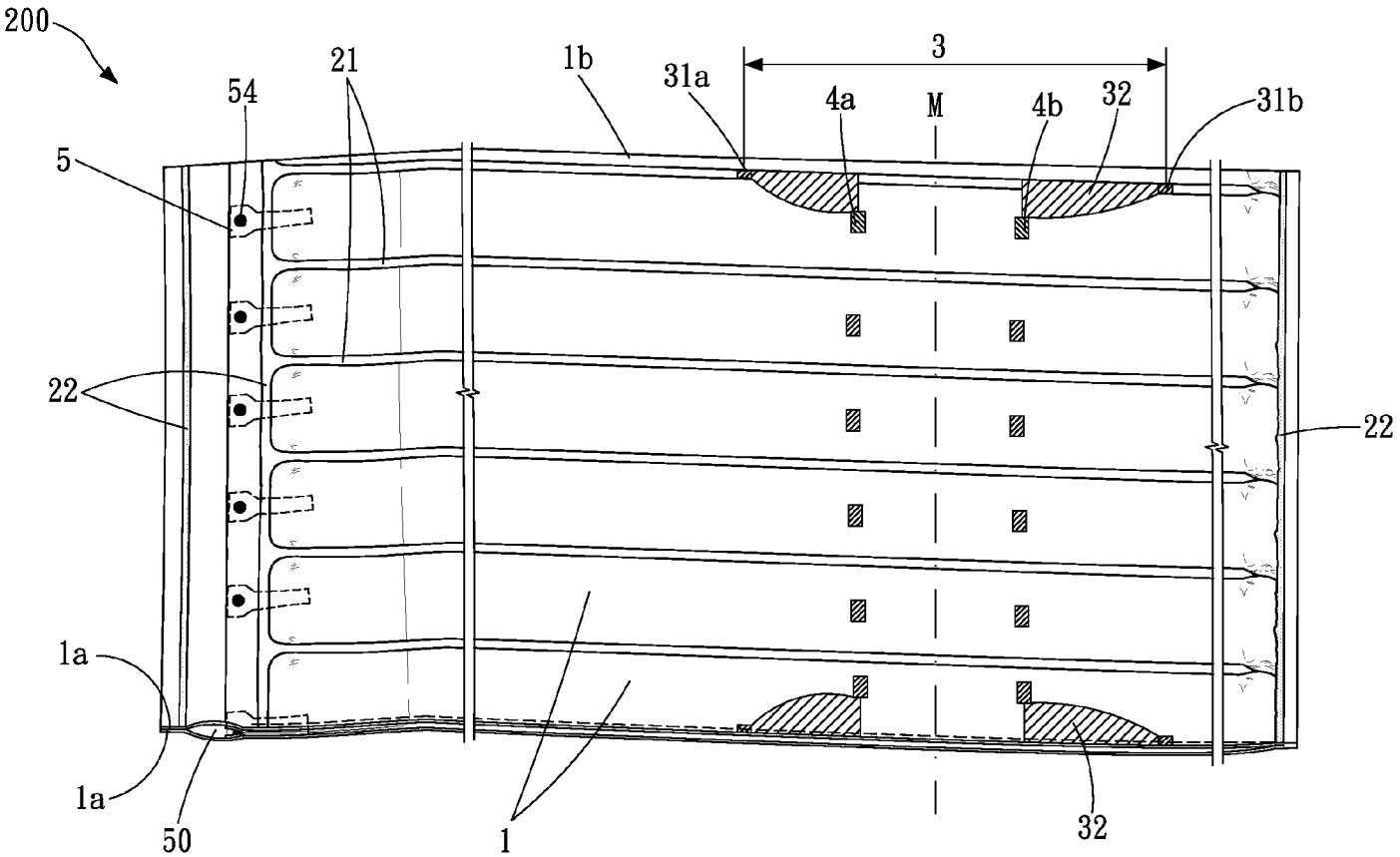
FIG. 10A is another schematic view of an outlook of air cylinder contraction in a lateral turning zone according to the present invention.
Figure 10B:
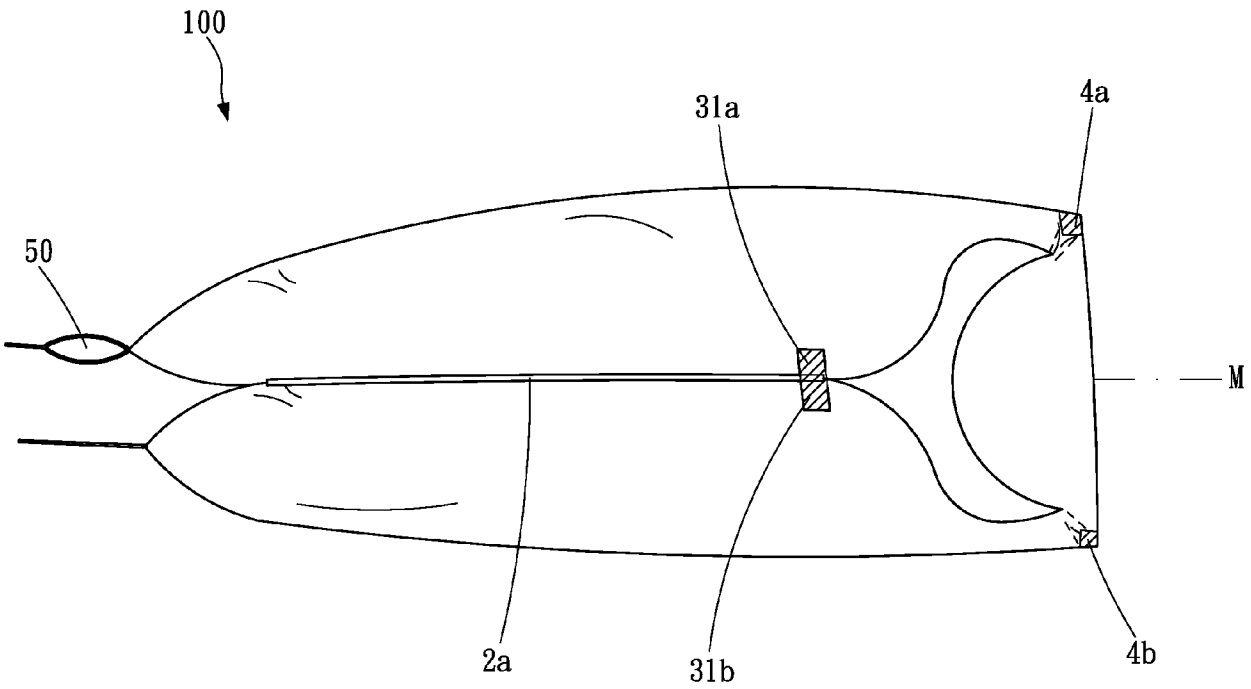
FIG. 10B is a cross-sectional view of FIG. 10A while being filled with air.

(3) Please refer to FIGS. 10A and 10B, showing another way to do the contraction according to the turning points 4*a*, 4*b*, i.e. respectively doing the contraction of the air cylinder 1 from the turning point 4*a* to the upper lateral non-heat sealing point and from the turning point 4*b* to the lower non-heat sealing point, allowing the expansion to be formed between the turning points 4*a*, 4*b* after air filling such that the air cylinder 1 between the turning points 4*a*, 4*b* expands substantially with saturated air because of no contraction between them, thereby maintaining the cushioning and preventing the turned air cylinder 1 from being bulged and pointed due to stacking.

Figure 11A:
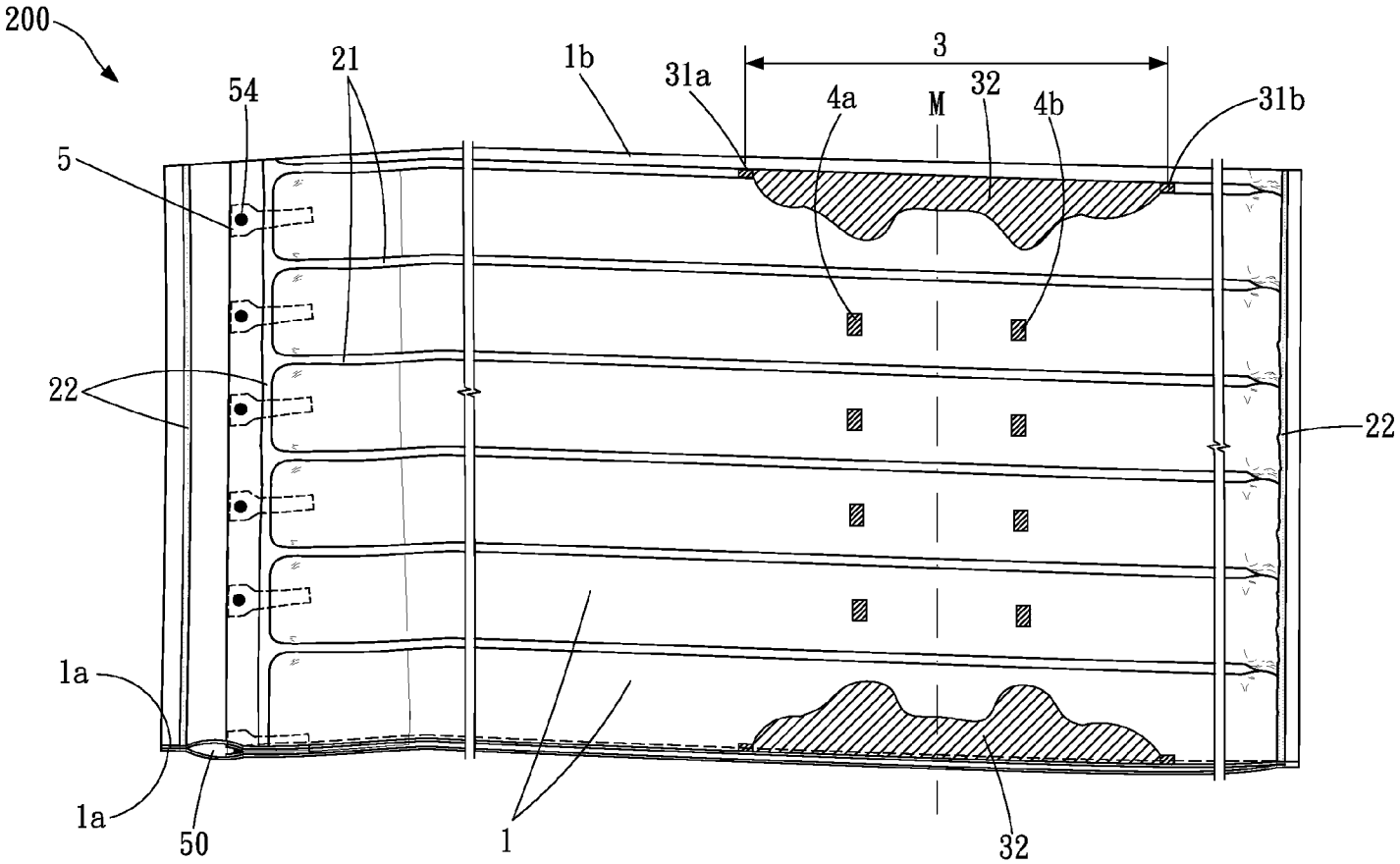
FIG. 11A is another schematic view of an outlook of air cylinder contraction in a lateral turning zone according to the present invention.
Figure 11B:
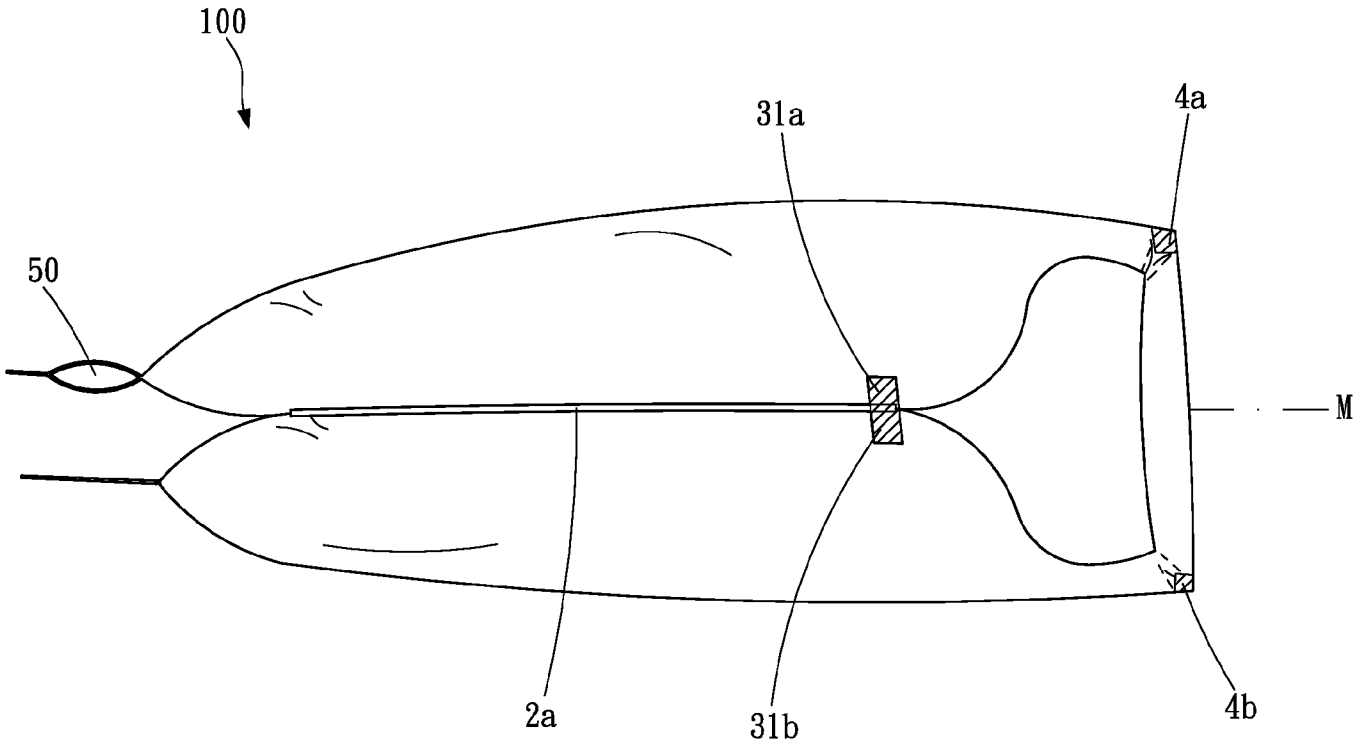
FIG. 11B is a cross-sectional view of FIG. 11A while being filled with air.

(4) Please refer to FIGS. 11A and 11B, further showing another way to do the contraction depending on the turning points 4*a*, 4*b*, i.e. contracting the air cylinder 1 from the node 31*a* to the node 31*b* at the predetermined lateral not-heat sealing position; in another word, allowing the air cylinder 1 at the non-heat sealing triangular opening 40 to be thinner, and the air cylinder 1 at other position maintains a original shape.

A method for making a cushioning air bag with a predetermined opening at an air cylinder turning zone, includes:

Step 101: providing an air cylinder sheet 200, constituted by a plurality of air cylinders 1 formed by adhering two sheets of outer film 1*a* through a plurality of longitudinal heat sealing lines 21 and a plurality of transversal heat sealing lines 22;

Step 102: adhering the two sheets of outer film 1*a* to form turning points 4*a*, 4*b* on the plurality of air cylinders 1 or the plurality of longitudinal heat sealing lines 21;

Step 103: configuring a turning middle line M on the air cylinder sheet 200, where the turning middle line M is parallel substantially to the plurality of transversal heat sealing lines 22;

Step 104: respectively configuring a plurality of nodes 31*a*, 31*b* at two sides of the turning middle line M with a predetermined distance therefrom;

Step 105: turning the air cylinder sheet 200 along the turning middle line M;

Step 106: adhering two sides 1*b* of the turned air cylinder 200 with a plurality of lateral heat sealing lines 2*a*, where the plurality of lateral heat sealing lines 2*a* are respectively extended from one end of the air cylinder sheet 200 to the nodes 31*a* and from another end thereof to the nodes 31*b*, and the non-heat sealing section 3 of the turning zone are respectively formed between the node 31*a* and the turning middle line M and between the node 31*b* and the turning middle line M; and Step 107: forming a cushioning bag body 100 with a triangular opening 40 having no lateral pointed angle after air filling.

A bottom surface 41*b* is formed between the turning points 4*a*, 4*b* of the air cylinder sheet 200, and the non-heat sealing section 3 of the turning zone is expanded to form a lateral polygonal opening 40, and a supporting surface 41*a* is forced on the bottom of the opening 40 after the air cylinder sheet 200 is filled with air.

The two sheets of outer film 1*a* are expanded through air filling, and two compressed corners 4 are formed on the two sheets of outer film 1*a*; the non-heat sealing section 3 of the turning zone and the two compressed corners 4 form substantially the triangular opening 40, and the bottom cushioning air cylinder 41 is formed between the two compressed corners 4. Consequently, a packed object is buffered by the bottom cushioning air cylinder 41.

A step of providing check valves 5 is further included after Step 101 of providing the two sheets of outer film 1*a*, where the structure of the check valve 5 is described above, the detail thereof is herein omitted. Air is filled in the air filling passageway 50 to pull the two sheets of outer film 1*a* apart outward, and the plurality of heat sealing switches 54 is then driven to further pull the two sheets of inner film 53 apart outward to open the check valves 5, allowing the air in the air filling passageway 50 to enter the plurality of outer films 1*a* via the check valves 5.

Furthermore, a space is provided between the any two adjacent longitudinal heat sealing lines 21 in Step 102 of providing a plurality of heat sealing lines 2. Specifically, the distance d between the compressed corner 4 is shorter than the length D of the bottom cushioning air cylinder 41, as FIG. 7 shows.

Other descriptions with respect to the method for making a cushioning air bag with a predetermined opening at a air cylinder turning zone are the same as the contents with respect to the cushioning air bag described above; they are herein omitted.

In the present invention, an object is placed in an internal space of the air cylinder bag via an object storing opening, and the surface of the object is supported by a plurality of bottom cushioning air cylinders, allowing the object to be buffered, and the object is wrapped by the air cylinder bag, allowing the object to be protected at the same time. Configuring non-heat sealing sections on lateral sides of the turning zone in advance and contracting with a predetermined area on the air cylinder of the turning zone are used to adjust a lateral cushioning effect. A triangle of a lateral corner is automatically formed after the cushioning bag is filled with air. Therefore, the lateral portion is flat without any pointed angle, and the cushioning air bag containing the object can be attached to a table face stably without inclination. The triangular air cylinder formed after being filled with air and expanded belongs to an edge corner cushioning adjustment and is helpful for reducing an outer box space, thereby reducing the transportation cost.

While the present invention has been described by the way of example and in terms of the preferred embodiments, it is to be understood that the invention need not be limited to the disclosed embodiments. On the contrary, it is intended to cover various modifications and similar arrangements included within the spirit and scope of the appended claims, the scope of which should be accorded the broadest interpretation so as to encompass all such modifications and similar structures.

What is claimed is:

1. A method for making a cushioning air bag with a predetermined opening in an air cylinder turning zone, comprising:

providing an air cylinder sheet, constituted by a plurality of air cylinders formed by adhering two sheets of outer film along a plurality of longitudinal heat sealing lines and a plurality of transversal heat sealing lines;

forming a plurality of turning points on the plurality of air cylinders or the plurality of longitudinal heat sealing lines, wherein the turning points form at least two turning lines parallel to at least one axis of the plurality of transversal heat sealing lines, wherein a virtual turning middle line is defined at the middle between the at least two turning lines, the virtual turning middle line is parallel to at least one axis of the plurality of the transversal heat sealing lines;

forming a portion of the two sheets of outer film at a non-heat sealing section in the turning zone to be stuck to each other to form at least one heat sealing block by heat sealing, the heat sealing block being narrower than one of the air cylinders that the heat sealing block is attached to, and being shorter than or a same length as the non-heat sealing section so as to contract an area of the air cylinders at the non-heat sealing section in the turning zone forming a plurality of nodes positioned on two outermost ones of the longitudinal heat sealing lines of the air cylinder sheet by marking or heat-sealing, the nodes being positioned on two opposite respective sides of the virtual turning middle line from each other and at a predetermined distance from the virtual turning middle line, wherein the nodes are not positioned at the turning lines, and the markings or heat seals which form the nodes are distinct from the longitudinal heat sealing lines;

turning the air cylinder sheet along the turning lines; and adhering two respective sides of the turned air cylinder sheet, which are on the opposite respective sides of the virtual turning middle line from each other, with a plurality of lateral heat sealing lines respectively positioned on the two outermost ones of the longitudinal heat sealing lines of the air cylinder sheet;

wherein, the plurality of lateral heat sealing lines are extended from the nodes and along the two outermost ones of the longitudinal heat sealing lines of the turned air cylinder sheet, two lateral sides of the air cylinder sheet between the plurality of nodes and the virtual turning middle line form the non-heat sealing section;

a bottom surface is formed between the plurality of turning points;

the non-heat sealing section being in the turning zone and being expanded to form a lateral polygonal opening in the turning zone, and a supporting surface is formed on a bottom of the lateral polygonal opening;

wherein the air cylinders include a first outermost air cylinder which is farthest away from a center of the cushioning air bag along a first direction of the virtual turning middle line, and a second outermost air cylinder which is farthest away from the center of the cushioning air bag along a second direction of the virtual turning middle line opposite the first direction, after the adhering the two respective sides, the nodes are positioned on the two outermost ones of the longitudinal heat sealing lines and positioned on the two opposite respective sides of the virtual turning middle line so that outermost ones of the nodes contact each other, and so that from the plurality of air cylinders, only each respective outermost air cylinder of the first and second outermost air cylinders has two portions of the respective outermost air cylinder positioned on two respective sides of the non-heat sealing section to contact each other;

a vertex of the lateral polygonal opening is formed by the outermost nodes which are contacting each other; and there is no protrusion at a corner of the air cylinders after the air cylinder sheet is filled with air so that all of each outermost side of the air cylinders in one of the first and second directions is flat.

2. The method according to claim 1, further comprising providing at least one check valve, stuck to a position between the two sheets of outer film by heat sealing, one part of the at least one check valve being positioned within the air cylinders.

3. The method according to claim 2, further comprising:

adhering the two sheets of outer film to form an air filling passageway on one side of the plurality of air cylinders, the air filling passageway being in air communication with the plurality of air cylinders, the at least one check valve comprising two sheets of inner film, and a heat resistant material being disposed between the two sheets of inner film; and adhering the two sheets of outer film and the two sheets of inner film by heat sealing to form at least one air inlet for each of the air cylinders to be in air communication with the air filling passageway.

4. The method according to claim 1, wherein the corner is disposed at one of the turning points.

5. A cushioning air bag with a predetermined opening in an air cylinder turning zone, comprising:

an air cylinder sheet constituted by a plurality of air cylinders formed by adhering two sheets of outer film along a plurality of longitudinal heat sealing lines and a plurality of transversal heat sealing lines;

a plurality of turning points disposed on the plurality of air cylinders or the plurality of longitudinal heat sealing lines, formed by adhering the two sheets of outer film, wherein the turning points form at least two turning lines parallel to at least one axis of the plurality of transversal heat sealing lines, a virtual turning middle line is defined at the middle between the at least two turning lines, and the virtual turning middle line is parallel to at least one axis of plurality of the transversal heat sealing lines;

at least one heat sealing block, the two sheets of outer film at a non-heat sealing section in the turning zone being stuck to each other to form the at least one heat sealing block by means of heat sealing, the heat sealing block being narrower than one of the air cylinders that the heat sealing block is attached to, and is shorter than or a same length as the non-heat sealing section so as to contract an area of the air cylinders at the non-heat sealing section in the turning zone;

a plurality of nodes positioned on two outermost ones of the longitudinal heat sealing lines of the air cylinder sheet by marking or heat-sealing, the nodes being positioned on two opposite respective sides of the virtual turning middle line from each other, and at a predetermined distance from the virtual turning middle line, wherein the nodes are not positioned at the turning lines, and the markings or heat seals which form the nodes are distinct from the longitudinal heat sealing lines; and a plurality of lateral heat sealing lines respectively positioned on the two outermost ones of the longitudinal heat sealing lines of the air cylinder sheet, and used to stick two sides of the air cylinder sheet together after the air cylinder is turned along the turning lines, wherein, the plurality of lateral heat sealing lines are extended from nodes and along the two outermost ones of the longitudinal heat sealing lines of the turned air cylinder sheet, two lateral sides of the air cylinder sheet between the plurality of nodes and the virtual turning middle line forming the non-heat sealing section in the turning zone;

wherein a bottom surface is formed between the plurality of turning points, the non-heat sealing section is expanded to form a lateral polygonal opening, and a supporting surface is formed on a bottom of the lateral polygonal opening, wherein the air cylinders include a first outermost air cylinder which is farthest away from a center of the cushioning air bag in a first direction along the virtual turning middle line, and a second outermost air cylinder which is farthest away from the center of the cushioning air bag in a second direction along the virtual turning middle line opposite the first direction, further wherein in a turned state of the air cylinder sheet, the nodes are positioned on the two outermost ones of the longitudinal heat sealing lines and positioned on the two opposite respective sides of the virtual turning middle line so that outermost ones of the nodes contact each other, and so that from the plurality of air cylinders, only each respective outermost air cylinder of the first and second outermost air cylinders has two portions of the respective outermost air cylinder positioned on two respective sides of the non-heat sealing section to contact each other, a vertex of the lateral polygonal opening is formed by the nodes which are contacting each other, and further wherein there is no protrusion at a corner of the air cylinders after the air cylinder sheet is filled with air so that all of each outermost side of the air cylinders in one of the first and second directions is flat.

6. The cushioning air bag according to claim 5, further comprising at least one check valve, stuck to a position between the two sheets of outer film by heat sealing, one part of the check valve being positioned within the air cylinders.

7. The cushioning air bag according to claim 6, further comprising:

an air filling passageway, formed on one side of the plurality of air cylinders by adhering the two sheets of outer film together, the air filling passageway being in air communication with the plurality of air cylinders, the at least one check valve comprising two sheets of inner film; and a heat resistant material being disposed between the two sheets of inner film, adhering the two sheets of outer film and the two sheets of inner films by means of heat sealing to form at least one air inlet for each of the air cylinders to be in air communication with the air filling passageway.

8. The cushioning air bag according to claim 5, wherein the corner is disposed at one of the turning points.

9. A method for making a cushioning air bag with a predetermined opening in an air cylinder turning zone, comprising:

providing an air cylinder sheet, constituted by a plurality of air cylinders formed by adhering two sheets of outer film along a plurality of longitudinal heat sealing lines and a plurality of transversal heat sealing lines;

forming a plurality of turning points on the plurality of air cylinders or the plurality of longitudinal heat sealing lines, wherein the turning points form at least two turning lines parallel to at least one axis of the plurality of transversal heat sealing lines, wherein a virtual turning middle line is defined at the middle between the at least two turning lines, and the virtual turning middle line is parallel to at least one axis of the plurality of transversal heat sealing lines;

forming at least one heat sealing block, the two sheets of outer film at a non-heat sealing section in the turning zone being stuck to each other to form the at least one heat sealing block by means of heat sealing, the heat sealing block being narrower than one of the air cylinders that the heat sealing block is attached to, and being shorter than or a same length as the non-heat sealing section so as to contract an area of the air cylinders at the non-heat sealing section in the turning zone forming a plurality of nodes on two outermost ones of the longitudinal heat sealing lines of the air cylinder sheet by marking or heat-sealing, the nodes being positioned on two opposite respective sides of the virtual turning middle line from each other and at a predetermined distance from the virtual turning middle line, wherein the nodes are not positioned at the turning lines and the markings or heat seals which form the nodes are distinct from the longitudinal heat sealing lines;

turning the air cylinder sheet along the turning lines; and adhering two sides of the turned air cylinder sheet with a plurality of lateral heat sealing lines respectively positioned on the two outermost ones of the longitudinal heat sealing lines of the air cylinder sheet;

wherein the plurality of lateral heat sealing lines are extended from two respective ends of the air cylinder sheets to the plurality of nodes, and two lateral sides of the air cylinder sheet between the plurality of nodes and the virtual turning middle line form the non-heat sealing section;

a bottom surface is formed between the plurality of turning points;

the non-heat sealing section being in the turning zone and being expanded to form a lateral polygonal opening in the turning zone, a supporting surface is formed on a bottom of the lateral polygonal opening;

wherein the air cylinders include a first outermost air cylinder which is farthest away from a center of the cushioning air bag in a first direction along the virtual turning middle line, and a second outermost air cylinder which is farthest away from the center of the cushioning air bag in a second direction along the virtual turning middle line opposite the first direction;

in a non-turned state of the air cylinder sheet, all of each outermost edge of the air cylinder sheet in the first and second directions is completely straight; and in a turned state of the air cylinder sheet, the nodes are positioned on the two outermost ones of the longitudinal heat sealing lines and positioned on the two opposite respective sides of the virtual turning middle line so that outermost ones of the nodes contact each other, and so that from the plurality of air cylinders, only each respective outermost air cylinder of the first and second outermost air cylinders has two portions of the respective outermost air cylinder positioned on two respective sides of the non-heat sealing section to contact each other, a vertex of the lateral polygonal opening is formed by the nodes which are contacting each other; and there is no protrusion at a corner of the air cylinders after the air cylinder sheet is filled with air so that all of each outermost side of the air cylinders in one of the first and second directions is flat.

10. The method according to claim 9, wherein the corner is disposed at one of the turning points.

* * * * *